US006450731B1

(12) United States Patent
Bohnhoff

(10) Patent No.: US 6,450,731 B1
(45) Date of Patent: Sep. 17, 2002

(54) SYSTEM FOR APPLYING A LIQUID, SUCH AS A DEICING LIQUID, UPON A PAVEMENT SURFACE

(76) Inventor: William W. Bohnhoff, 12501 E. Amherst Cir., Aurora, CO (US) 80014

( * ) Notice: Subject to any disclaimer, the term of this patent is extended or adjusted under 35 U.S.C. 154(b) by 0 days.

(21) Appl. No.: 09/624,799

(22) Filed: Jul. 24, 2000

Related U.S. Application Data

(60) Continuation-in-part of application No. 09/169,532, filed on Oct. 9, 1998, now Pat. No. 6,095,718, which is a division of application No. 08/796,304, filed on Feb. 7, 1997, now Pat. No. 5,848,856.

(51) Int. Cl.[7] ..... B05C 5/00

(52) U.S. Cl. ..... 405/37; 405/36; 239/201; 404/71

(58) Field of Search ..... 239/200, 201, 239/202, 207, 206, 267, 268; 405/36, 37, 39, 40, 41, 53, 130, 131; 404/2, 3, 71, 77, 79, 95; 138/106, 108, 112, 105

(56) References Cited

U.S. PATENT DOCUMENTS

| | | | | | |
|---|---|---|---|---|---|
| 479,979 | A | * | 8/1892 | Glenn | 239/202 |
| 500,853 | A | * | 7/1893 | Clark | 239/201 |
| 706,289 | A | * | 8/1902 | Young | 239/99 |
| 2,183,657 | A | | 12/1939 | Page | 405/50 X |
| 2,793,910 | A | * | 5/1957 | Wiebe | 239/201 |
| 3,547,355 | A | * | 12/1970 | Salazar | 239/547 |
| 3,795,180 | A | | 3/1974 | Larsen | 405/36 |
| 3,908,385 | A | | 9/1975 | Daniel et al. | |
| 3,990,247 | A | | 11/1976 | Palmer | 405/16 |
| 4,023,506 | A | | 5/1977 | Robey | |
| 4,044,179 | A | | 8/1977 | Haas, Jr. | |
| 4,268,993 | A | | 5/1981 | Cunningham | |
| 4,497,440 | A | * | 2/1985 | Galloway | 239/201 |
| 4,576,511 | A | | 3/1986 | Vidal, Jr. | |
| 4,733,989 | A | | 3/1988 | Harriett | 405/43 |
| 4,832,526 | A | | 5/1989 | Funkhouser, Jr. | |
| 4,880,333 | A | | 11/1989 | Glasser et al. | 405/45 X |
| 4,881,846 | A | | 11/1989 | Burkstaller | |
| 4,913,596 | A | | 4/1990 | Lambert, III | |
| 4,917,536 | A | | 4/1990 | Glasser | 405/45 |
| 4,925,342 | A | | 5/1990 | Hendy | 405/36 X |
| 4,934,865 | A | | 6/1990 | Varkonyi et al. | 405/36 X |
| 4,943,185 | A | | 7/1990 | McGuckin et al. | 405/43 X |
| 4,956,951 | A | | 9/1990 | Kannankeril | 405/45 X |
| 5,064,308 | A | | 11/1991 | Almond et al. | |
| 5,123,778 | A | | 6/1992 | Bohnhoff | |
| 5,197,824 | A | | 3/1993 | Paurat et al. | 405/36 X |
| 5,219,243 | A | | 6/1993 | McCoy | |
| 5,250,340 | A | | 10/1993 | Bohnhoff | 405/41 X |
| 5,306,317 | A | | 4/1994 | Yoshizaki | 405/36 X |
| 5,848,856 | A | | 12/1998 | Bohnhoff | |
| D442,704 | S | * | 5/2001 | Lee | D25/118 |

FOREIGN PATENT DOCUMENTS

| | | |
|---|---|---|
| WO | WO 98/35106 | 8/1998 |

* cited by examiner

*Primary Examiner*—Heather Shackelford
*Assistant Examiner*—Sunil Singh

(57) ABSTRACT

A system for applying a liquid, such as a deicing liquid, to a surface material, such as soil, sand, gravel, concrete, and asphalt. The system includes a mat possessing an array of upstanding tubular members and a pipe system maintained in the interstitial regions between the tubular members. In addition, a series of ports or nozzles may extend upwardly from the pipe such that the liquid drips or is sprayed on the surface of the material.

62 Claims, 4 Drawing Sheets

SYSTEM FOR APPLYING A LIQUID, SUCH AS A DEICING LIQUID, UPON A PAVEMENT SURFACE

CROSS REFERENCE TO RELATED APPLICATIONS

This application is a continuation-in-part of application Ser. No. 09/169,532 filed on Oct. 9, 1998, now U.S. Pat. No. 6,095,718, which is a divisional application of Ser. No. 08/796,304 filed on Feb. 7, 1997, and now U.S. Pat. No. 5,848,856. The disclosures of the above-mentioned applications are hereby incorporated by reference.

BACKGROUND OF THE INVENTION

The present invention generally relates to a system for applying a liquid, such as a deicing liquid, upon a pavement surface. The present invention also relates to a pavement for facilitating the movement of traffic thereon, to a molded mat for stabilizing a material in which the mat is disposed and for supporting and maintaining a pipe beneath a surface of the material, and to a system for heating a material, such as a pavement material, and to a method of delivering a fluid to a material surface.

Many surfacing materials, such as soil, sand, gravel, concrete, and asphalt are subject to migration and erosion, as well as damage from vehicular and pedestrian traffic. Mats, such as mats possessing an array of upstanding tube segments, have been utilized to stabilize such surfacing materials and to help prevent migration and erosion, as well as to inhibit compaction, cracking, etc.

The prior art mats including an array of upstanding tubular segments have been applied in the following manners, for example. Such a mat is laid upon a bed of gravel, and then sod with grass or other vegetation is rolled over the mat and pressed into the tubular segments of the mat. Because the tubular segments prevent the soil from being compacted and thereby killing the grass, the sod may be subject to vehicular and pedestrian traffic without killing the grass or other vegetation. Such a mat has also been designed for employment in paving roads with asphalt. The mat is first laid on the road bed, and then asphalt is rolled over the mat and into the tubular segments. The tubular segments help prevent the asphalt from migrating, which might produce ruts in the road, and also are believed to help minimize disintegration and cracking of the asphalt.

The aforementioned types of mats have been described in the inventor's U.S. Pat. No. 5,250,340 and the patent applications and patents mentioned therein, the disclosures of every one of which are incorporated herein by reference.

The present invention generally relates to the use of such mats or modified versions of such mats in combination with pipe systems for delivering a fluid to the material in which the mat is embedded.

SUMMARY OF THE INVENTION

The present invention generally relates to a system for applying a liquid, such as a deicing liquid, to a surface material, such as soil, sand, gravel, concrete, and asphalt. The system includes a mat possessing an array of upstanding tubular members, and a pipe system maintained in the interstitial regions between the tubular members. In addition, a series of ports or nozzles may extend upwardly from the pipe such that the liquid drips or is sprayed on the surface of the material.

BRIEF DESCRIPTION OF THE DRAWINGS

The invention will be described with reference to the accompanying drawings, wherein like reference numerals refer to the same item.

DETAILED DESCRIPTION OF THE PREFERRED EMBODIMENTS

Figure 1:
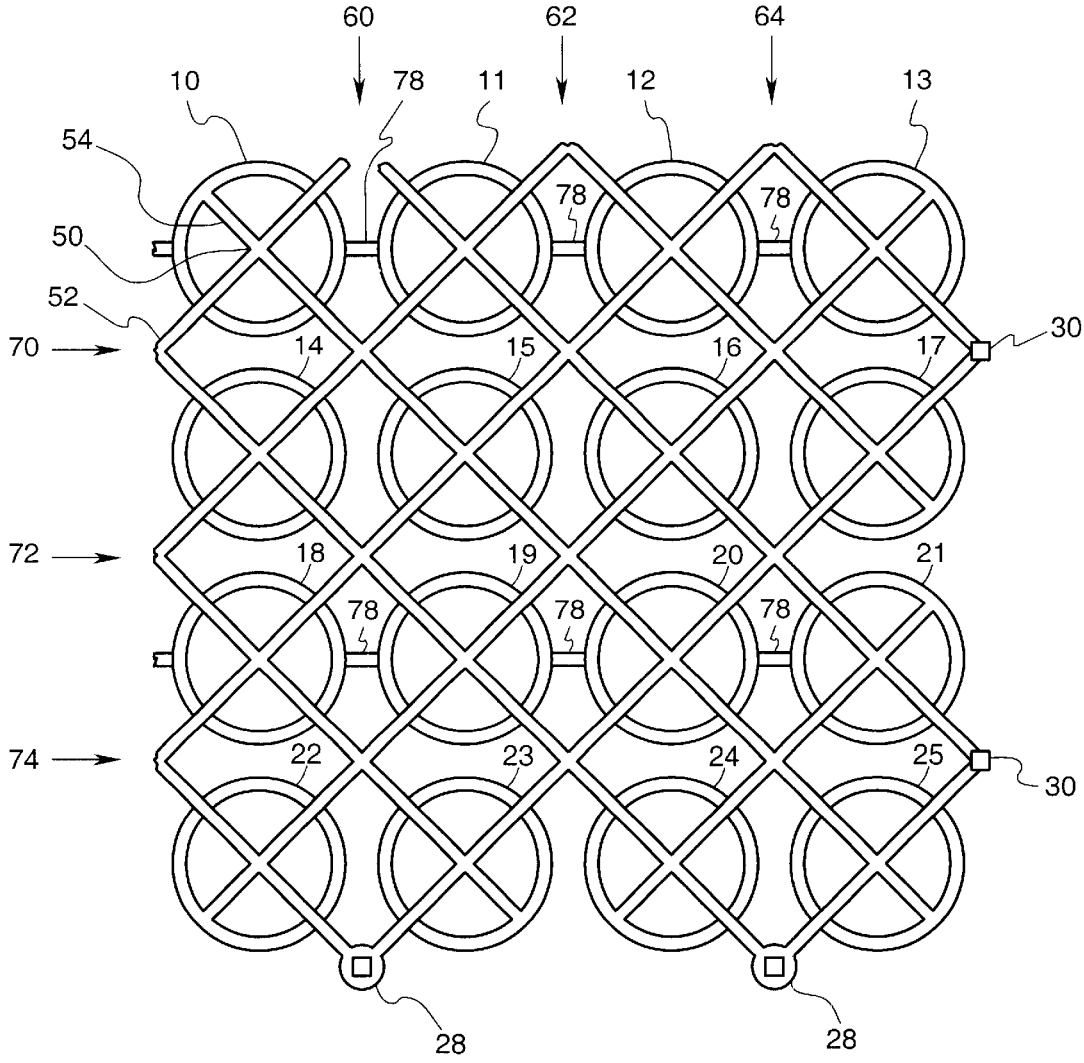
FIG. 1 is a bottom plan view of a portion of a mat in accordance with one embodiment of the present invention.

There is shown in FIG. 1 a portion of a mat for stabilizing particulate materials, which mat includes a plurality of tubular members which, in the illustrated embodiment, take the form of cylindrical rings designated by reference numerals 10–25 disposed in a uniform rectangular array defined by a plurality of perpendicular rows and columns. For example, as shown in FIG. 1, tubular members 10, 11, 12, and 13 define the upper-most row, while tubular members 10, 14, 18, and 22 define the left-most column. It should be noted that the use of tubular members of other than cylindrical shape may be employed within the scope of the present invention. For example, tubular members having oval, hexagonal, rectangular, square, triangular, octagonal, and other cross-sectional shapes may be utilized. Further, the tubular members may be disposed in non-rectangular arrays, for example in circular patterns, or randomly distributed.

In order to allow a plurality of the mats to be secured together to form a large mat, first and second cooperating fasteners are formed on the side edges of the mat. Although the cooperating members may take the form as disclosed in U.S. Pat. No. 5,250,340, in the illustrated embodiment, the first fastener members may take the form of a plurality of sockets, designated by reference numerals 28, spread along two opposing sides of a quadrilateral mat. The second fastener members in the illustrated embodiment take the form of a pair of upstanding prongs, designated by reference numerals 30, spaced along the other two sides of the mat, such that the prongs 30 are located opposite the sockets 28.

Two of the mats may be secured in an adjacent relation by inserting the prongs 30 spaced along one side edge of one mat through the sockets 28 spaced along a side edge of another mat.

Figure 2A:
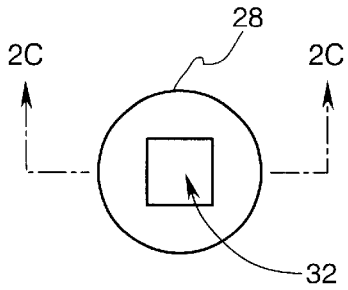
FIG. 2A is a top plan view of a socket utilized in the mat as shown in FIG. 1.
Figure 2B:
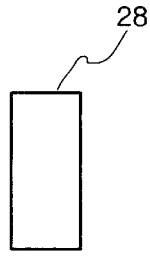
FIG. 2B is a side view of the socket shown in FIG. 2A.
Figure 2C:
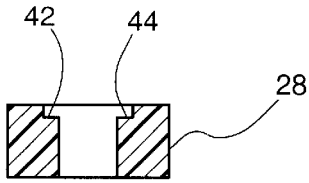
FIG. 2C is a cross-sectional view of the socket shown in FIG. 2A, taken along the line 2C—2C.
Figure 2D:
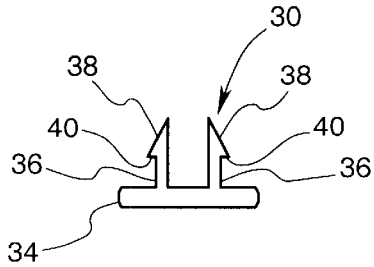
FIG. 2D is a side view of a pair of prongs utilized in the mat as shown in FIG. 1 and which is designed to cooperate with the socket as shown in FIGS. 2A–C in an adjacent mat.
Figure 2E:
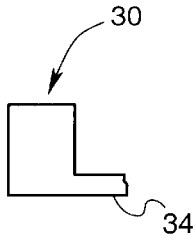
FIG. 2E is another side view of the prongs shown in FIG. 2B.

As shown in FIG. 2A, each socket may include a centrally positioned, substantially square aperture 32 therethrough, which is adapted to receive the pair of prongs 30 As shown in FIG. 2D, each one of the prongs 30 extends generally upright from a base 34, and includes, a trunk section 36 and a distal flange section 38 having a clasping lip 40. As best shown in FIG. 2B, the distance between the outermost sections of the trunks 36 of the prongs 30 is only slightly less than width of the square shaped aperture 32 in the socket 28. When the prongs 30 are pressed centrally against the socket 28, the distal ends of the flange sections 38 will extend slightly into the aperture 32 of the socket 28 and will abut opposing walls of the socket 28 that define the aperture 32. By further forcing the prongs 30 toward the socket 28, the flange sections 38 of the prongs 30 will resiliently deflect toward each other so that the prongs 30 may be further inserted into the aperture 32 of the socket 28. Since the width of the socket 28 is approximately equal to the height of the trunk 36 of each of the prongs 30, when the prongs 30 are sufficiently inserted through the aperture 32 of the socket 28, the flange portions 38 of the prongs 30 will spring away from each other, back to their original upstanding position, such that the lip 40 of each of the flange sections 34 overlaps a surface of the socket 28 adjacent to the aperture 32. As shown in FIG. 2C the opposing edges of the aperture 32 along one surface of the socket 28 are indented to form a pair of opposing indentations 42, 44, which are designed to accommodate the lip 40 of a corresponding flange section 38 of each of the prongs 30. In such a condition, the prongs are maintained in a cooperative fastening relationship with the socket 28. The prongs 30 may be disengaged from the associated socket 28 by manually compressing the flange portions 38 toward each other and then withdrawing the prongs 30 from the aperture 32 and the socket 28.

The tubular members 10–25 are preferably integrally molded with a planar grid formed by a plurality of intersecting perpendicular struts. For example, the tubular member 10 is disposed centrally with respect to an intersection 50 of perpendicular struts 52 and 54. It is contemplated that the struts may be disposed in other than a perpendicular rectangular grid pattern, for example, concentric ring struts with intersecting radially extending struts may be employed. Additionally, the struts may be arranged such that the grid openings are circular, oval, triangular, hexagonal, octagonal, etc. within the spirit and scope of the present invention.

In order to add strength and rigidity to the grid and tubular members, a plurality of longitudinal ribs (not shown) may extend along internal cylindrical side walls of the tubular members such that each of the ribs intersects one of the struts. In the illustrated embodiment, each cylindrical tubular member would possess four such longitudinal ribs disposed at 90° angular intervals.

The mat shown in FIG. 1 is preferably integrally molded from a semi-rigid thermal plastic material, preferably high density polyethylene, in an injection molding process. Polypropylene, thermoplastics, or plastic resins may also be suitable materials. The material selected should provide sufficient rigidity to resist undesired deformation and lateral shifting, but also be sufficiently flexible to allow the mat to be rolled for shipment and also to accommodate uneven terrain and base materials.

It will be seen that the columns and rows of tubular members are spaced so that a series of parallel, linear passages or pathways are formed between the columns (i.e., the pathways indicated by the arrows 60, 62, and 64 in FIG. 1) and also between the rows (i.e., as indicated by the arrows 70, 72, and 74 in FIG. 1) of tubular members. Although the embodiment as shown in FIG. 1 depicts a series of parallel, linear passageways that are orthogonal to each other, it should be appreciated that in a different array of tubular members, the pathways may be non-linear and may be non-orthogonal.

Figure 3:
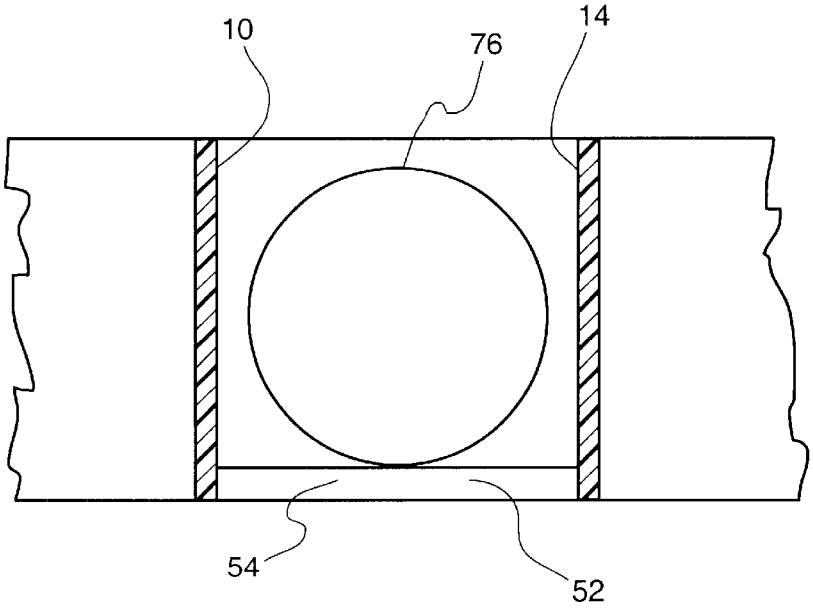
FIG. 3 is a fragmented side schematic illustration of a mat and pipe system in accordance with one embodiment of the present invention taken in the direction of arrow 70 in FIG. 1.

FIG. 3 depicts a fragmented, cross-sectional view of the mat as shown in FIG. 1 taken in a direction generally along the line of arrow 70 and depicting a portion of tubular member 10 and of tubular member 14 and interconnecting struts 52, 54. In addition, FIG. 3 generally illustrates a length of pipe 76 extending along the pathway 70. The pipe 76 may be fashioned of metal, plastic, or elastomer material and may be substantially rigid or deformable, for example. The pipe 76 generally possesses a cylindrical cross-sectional configuration, with the outer diameter of the pipe 76 being slightly less than the shortest distance between the tubular member 10 and the tubular member 14. Also preferably, when the pipe 76 rests upon the struts 52, 54, the upper peripheral edge of the pipe 76 is disposed slightly below the topmost edge of the tubular members 10, 14. In such a preferred relationship, when the mat is covered with material such as soil or asphalt, and traffic upon the material tends to wear away the upper most layer of material, it will be appreciated that the upper edges of the tubular members 10, 14, and not the pipe, will bear the weight of any traffic, thus protecting the pipe 76 from damage.

Figure 4:
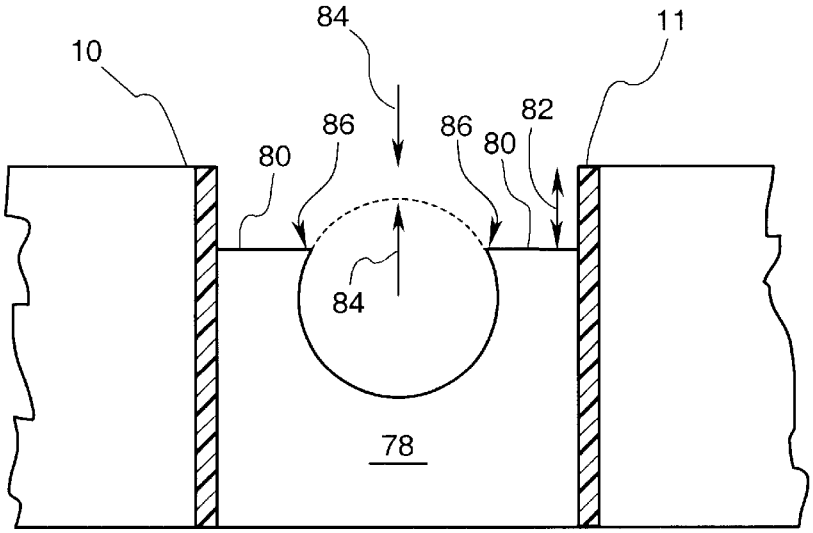
FIG. 4 is another fragmented side schematic illustration of a mat and pipe system in accordance with one embodiment of the present invention.

As shown in FIG. 1, a series of stiffening ribs 78 may extend between tubular members in a row of tubular members. Such ribs 78 may also, alternatively, extend between tubular members in a column of tubular members. The stiffening ribs 78 generally extend along a line interconnecting the centers of the tubular members. FIG. 4 shows a fragmented, cross-sectional view of the mat, generally taken in the direction of the arrow 60, showing the tubular member 10 and the tubular member 11 as well as a stiffening rib 78 extending therebetween. Preferably the stiffening rib 78 is integrally molded with the other portions of the mat. The stiffening rib 78 as shown in FIG. 4 includes an upper, generally linear surface or edge 80 spaced a short distance 82 below the upper edges of the tubular members 10, 11. The upper edge 80 also includes a recess or depression that is located mid-way along the upper edge 80 and that is shaped as an arcuate portion of a circle. It should be appreciated that the arcuate portion of the circle may range from a few degrees to 360°, and may be in the range of 45 to 120°, and may be in the range of 160 to 270°. As shown in FIG. 4, the arcuate recess is about 250°. The arcuate configuration is adapted to receive a pipe (not shown) having a cylindrical configuration in which the radius of the outer peripheral surface of the pipe is slightly less than the radius of the arcuate configuration of the rib 78. Thus, the rib 78 is designed to maintain and hold a pipe. When the pipe is placed within the arcuate recess of the rib 78, then the upper peripheral edge of the pipe will be spaced a short distance 84 below the upper edges of the tubular members 10, 11. Again, such positioning helps to protect the pipe from damage due to traffic.

The invention contemplates that non-cylindrical pipes may be employed and that the recess in the upper edge 80 may possess a configuration that conforms with the configuration of a portion of the pipe periphery.

Although it is contemplated that the mat may be slightly flexible so that the rib 78 also flexes to receive the pipe, the invention also contemplates that the upper edge 80 of the rib 78 shown in FIG. 4 forms a pair of opposing corners or ears 86 that may be resiliently flexed relative to the remaining portion of the rib 78 so that the pipe may be inserted into the arcuate recess in a slightly "snap fit" retention due to the ears 86 assuming their normal position after deflection.

It should also be appreciated that the pipe 76 as shown in FIG. 3 may be made sufficiently small in diameter so that when the pipe 76 rests upon the struts 52, 54, the pipe 76 will be located below the pipe (not shown) that occupies the arcuate recess in the rib 78 as shown in FIG. 4. Thus, the pipes may also form an orthogonal grid in the directions of the pathways 60, 62, 64 and 70, 72, 74, as shown in FIG. 1. It should be further appreciated, however, that only pipes disposed along the vertical passageway 60, 62, 64 might be employed, or that pipes disposed in alternating passageways or at regularly spaced passageways may be employed.

Figure 5:
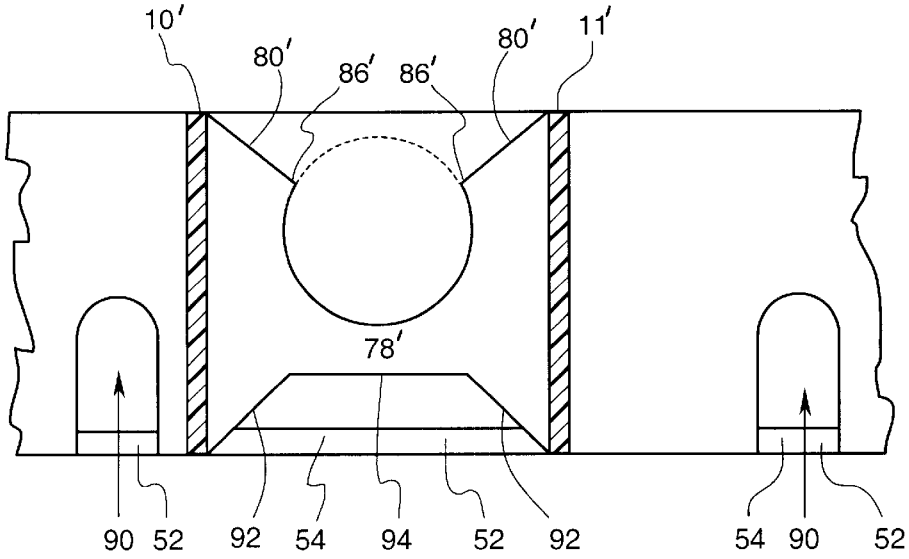
FIG. 5 is another fragmented side schematic illustration of a mat and pipe system in accordance with one embodiment of the present invention.

FIG. 5 shows a variation of a mat, tubular members, and rib 78 shown in FIG. 4. The variation is especially adapted to facilitate the movement of a particulate or viscous material, such as soil or asphalt, throughout all interstitial regions of the mat. As shown in FIG. 5, the tubular members 10', 11' include arched apertures 90 extending upwardly from the bottom edge of each tubular member 10', 11'. Also, the rib 78' includes an upper surface or edge 80' that is beveled downwardly from the upper edge of each adjacent tubular member 10', 11'. Such configuration provides more strength to the rib 78 than is created by the linear upper edge 80 of the rib 78 as shown in FIG. 4. The lower edge of the rib 78' as shown in FIG. 5 includes a lower edge comprising a central horizontal surface 94 connected through beveled surfaces 92 to a corresponding lower edge of each tubular member 10', 11'. The lower edge of the rib 78' thus creates a lower aperture beneath the rib 78'. It will be appreciated that when particulate or viscous material covers or is spread over the mat, the mat construction of FIG. 5 permits the material to more readily migrate through and to completely fill the interstitial regions of the mat, whereby there are no voids, and whereby weight from traffic applied to an upper surface of the material will be firmly supported. Otherwise, a material with voids might result in depression, cracks, and other deformities of the upper surface of the material.

Figure 6:
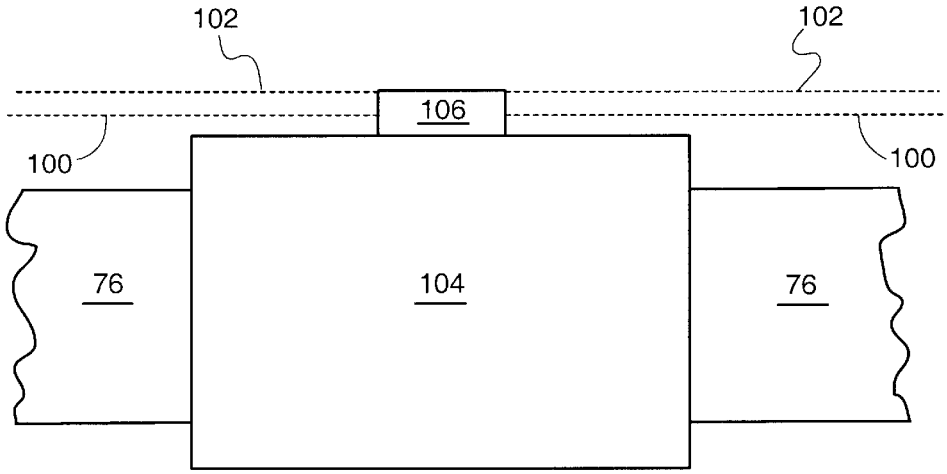
FIG. 6 is a side schematic illustration of a pipe that may be used in an embodiment of the present invention.

There is shown in FIG. 6 a schematic illustration of a pipe 76 maintained within a pathway of the mat. The dashed line 100 above the pipe 76 represents the plane formed by the upper edges of the various tubular members of the mat. The dashed line 102 above the pipe 76 represents the upper surface of the material in which the mat and pipe 76 are disposed. Segments of the pipe 76 may be joined together by a cylindrical collar 104, which is threadably secured, adhesively secured, or otherwise secured to adjacent ends of the segments of the pipe 76. A valve stem 106 or a nozzle may extend generally perpendicularly from the pipe 76/collar 104 in a generally vertical or upward direction so that the upper edge of the valve stem 106 is approximately coextensive with the upper surface 102 of the material. The valve stem 106 is preferably ring-shaped, and may be formed of plastic, metal, or an elastomer. Preferably a hard-wear elastomer is utilized. Preferably there is a substantially open area or void in the material substantially immediately above the valve stem 106 or nozzle. The valve is preferably a one-way valve which permits liquid within the pipe 76 to escape through the valve stem 106 when liquid pressure within the pipe 76 reaches a predetermined magnitude or level. The valve may simply permit liquid from the pipe 76 to ooze through the valve and onto the upper surface of the material 102, or more preferably, may spray the liquid above and onto the upper surface 102 of the material. When the instant invention is employed in the environments of sod or concrete or asphalt pavings for a driveway, then the valve may be a "pop up" valve such as valves conventionally used for sprinkler systems for lawns. When the invention is employed with asphalt or concrete airport runways or asphalt or concrete roads, then the valve is preferably not a "pop up" type valve, since when the valve is exposed above the upper surface 102 of the material, the wheels of frequent vehicular traffic might damage the valve.

It should be appreciated that instead of a valve being located at the location where liquid from the pipe 76 is to be discharged upwardly and onto the upper surface 102 of the material, a main valve may be used to permit or prevent liquid from entering the pipe system. When such a main valve allows liquid to enter the pipe system, then the liquid may automatically pass through the pipe 76, through a passive port or nozzle, and upwardly onto the upper surface 102 of the material.

The present invention may be used to deliver water, or a combination of water and fertilizer to sod. It may also employed to deliver a deicing fluid, such as ethyl glycol, onto a pavement such as a sidewalk, a driveway, an airport runway, or a road.

It should be further appreciated that in an alternative embodiment of the present invention, liquid within the pipe need not escape outside the pipe and that the pipe may be used to deliver a relatively hot liquid or fluid (such as steam) to a material surrounding the mat and pipe 76. For example, if the mat and pipe system of the present invention is disposed in sod beneath a football or soccer field, then a hot gas or liquid may be passed through the pipe system so as to heat the sod and keep the field from freezing or thaw a frozen field. In such an embodiment, it is preferred that the temperature of the fluid be hotter than the freezing point of water, and even more preferably, be at least about 60° F. In such a system, the fluid may be recirculated and passed through a heater to elevate the temperature of the fluid.

Although particular embodiments of the particular invention are described and illustrations herein, it should be recognized that modifications and variations may readily occur to those skilled in the art and that such modifications and variations may be made without departing from the spirit and scope of my invention. Consequently, my invention as claimed below may be practiced otherwise than as specifically described above.

What is claimed is:

1. A system for applying a liquid upon a surface of a pavement material, comprising (a) a molded mat substantially including (1) a substantially planar grid formed substantially by a plurality of intersecting struts, (2) a plurality of substantially upstanding tubular members spaced uniformly on and integrally molded with said grid with said tubular members being spaced such that a series of substantially parallel, substantially straight pathways are defined by said tubular members, and (3) at least one integrally molded rib substantially laterally extending across at least one said pathway;

(b) at least one pipe extending through a corresponding one of said pathways and resting upon said at least one rib; and (c) valve means in operative communication with said at least one pipe for selectively permitting said liquid to flow within said at least one pipe substantially laterally to the exterior of said at least one pipe and onto said pavement material surface.

2. A system according to claim 1 wherein said valve means selectively permits such flow only when the pressure of said liquid within said at least one pipe achieves a predetermined pressure level.

3. A system according to claim 1 wherein said at least one rib includes an upper surface possessing a configuration substantially conforming to the peripheral configuration of said at least one pipe in the region where said at least one pipe rests upon said at least one rib.

4. A system according to claim 3 wherein said at least one pipe possesses a substantially cylindrically periphery in the region where said at least one pipe rests upon said at least one rib and wherein said at least one rib includes an upper surface possessing a substantially arcuate configuration substantially conforming to the peripheral configuration of said at least one pipe in said region.

5. A system according to claim 4 wherein said arcuate configuration forms substantially an arc in the range of about 45 to 120 degrees.

6. A system according to claim 4 wherein said arcuate configuration forms substantially an arc in the range of about 160 to 270 degrees.

7. A system according to claim 4 wherein said pavement material consists essentially of asphalt.

8. A system according to claim 3 wherein said pavement material consists essentially of asphalt.

9. A system according to claim 1 wherein said at least one rib includes a cavity through which said at least one pipe extends.

10. A system according to claim 9 wherein said at least one rib includes an upper opening and further includes at least one resilient ear flexible in at least one direction to facilitate the placement of said at least one pipe into and the removal of said at least one pipe from a position of extension within said at least one rib cavity.

11. A system according to claim 10 wherein said pavement material consists essentially of asphalt.

12. A system according to claim 9 wherein said pavement material consists essentially of asphalt.

13. A system according to claim 1 wherein said pavement material consists essentially of asphalt.

14. A pavement for facilitating the movement of traffic comprising:

(a) a molded mat substantially including (1) a substantially planar grid formed substantially by a plurality of intersecting struts, (2) a plurality of substantially upstanding tubular members spaced uniformly on and integrally molded with said grid with said tubular members being spaced such that a series of substantially parallel, substantially straight pathways are defined by said tubular members, and (3) at least one integrally molded rib substantially laterally extending across at least one said pathway;

(b) at least one pipe extending through a corresponding one of said pathways and resting upon said at least one rib;

(c) a nozzle in operative communication with said at least one pipe and extending substantially laterally from said at least one pipe;

(d) valve means in operative communication with said at least one pipe for selectively permitting a liquid to flow within said at least one pipe through said nozzle substantially laterally to the exterior of said at least one pipe;

(e) a paving material substantially saturating the region within said tubular members, around said tubular members, and around said at last one pipe, said paving material having an upper, substantially horizontal surface, and said mat, said at least one pipe, and said valve means located substantially below said horizontal surface, said paving material having a substantially open area or void substantially immediately above said nozzle such that said liquid within said at least one pipe may flow through said nozzle, to the exterior of said at least one pipe, and onto said horizontal surface.

15. A pavement according to claim 14 wherein said valve means selectively permits such flow only when the pressure of said liquid within said at least one pipe achieves a predetermined pressure level.

16. A pavement according to claim 14 wherein said at least one rib includes an upper surface possessing a configuration substantially conforming to the peripheral configuration of said at least one pipe in the region where said at least one pipe rests upon said at least one rib.

17. A pavement according to claim 16 wherein said at least one pipe possesses a substantially cylindrically periphery in the region where said at least one pipe rests upon said at last one rib and wherein said at least one rib includes an upper surface possessing a substantially arcuate configuration substantially conforming to the peripheral configuration of said at least one pipe in said region.

18. A pavement according to claim 17 wherein said arcuate configuration forms substantially an arc in the range of about 45 to 120 degrees.

19. A pavement according to claim 17 wherein said arcuate configuration forms substantially an arc in the range of about 160 to 270 degrees.

20. A pavement according to claim 17 wherein said paving material consists essentially of asphalt.

21. A pavement according to claim 16 wherein said paving material consists essentially of asphalt.

22. A pavement according to claim 14 wherein said at least one rib includes a cavity through which said at least one pipe extends.

23. A pavement according to claim 22 wherein said at least one rib includes an upper opening and further includes at least one resilient ear flexible in at least one direction to facilitate the placement of said at least one pipe into and the removal of said at least one pipe from a position of extension within said at least one rib cavity.

24. A pavement according to claim 23 wherein said paving material consists essentially of asphalt.

25. A pavement according to claim 22 wherein said paving material consists essentially of asphalt.

26. A pavement according to claim 14 wherein said paving material consists essentially of asphalt.

27. A system for applying a liquid upon a surface of a material, comprising:

(a) a mat substantially including (1) a substantially planar grid formed substantially by a plurality of interesting struts, (2) a plurality of substantially upstanding substantially tubular members spaced substantially in an array on said grid with said tubular members being spaced such that a series of pathways are defined by said tubular members, and (3) at least one rib substantially laterally extending across at least one said pathway;

(b) at least one pipe extending through a corresponding one of said pathways and resting upon said at least one rib; and (c) valve means in operative communication with said at least one pipe for selectively permitting said liquid to flow within said at least one pipe substantially laterally to the exterior of said at least one pipe and onto said material surface.

28. A system according to claim 27 wherein said valve means selectively permits such flow only when the pressure of said liquid within said at least one pipe achieves a predetermined pressure level.

29. A system according to claim 27 wherein said at least one rib includes an upper surface possessing a configuration substantially conforming to the peripheral configuration of said at least one pipe in the region where said at least one pipe rests upon said at least one rib.

30. A system according to claim 29 wherein said at least one pipe possesses a substantially cylindrically periphery in the region where said at least one pipe rests upon said at least one rib and wherein said at least one rib includes an upper surface possessing a substantially arcuate configuration substantially conforming to the peripheral configuration of said at least one pipe in said region.

31. A system according to claim 30 wherein said arcuate configuration forms substantially an arc in the range of about 45 to 120 degrees.

32. A system according to claim 30 wherein said arcuate configuration forms substantially an arc in the range of about 160 to 270 degrees.

33. A system according to claim 27 wherein said at least one rib includes a cavity through which said at least one pipe extends.

34. A system according to claim 33 wherein said at least one rib includes an upper opening and further includes at least one resilient ear flexible in at least one direction to facilitate the placement of said at least one pipe into and removal of said at least one pipe from a position of extension within said at least one rib cavity.

35. A system according to claim 34 wherein said material consists essentially of asphalt.

36. A system according to claim 27 wherein said material consists essentially of sod and grass.

37. A system according to claim 27 wherein said material consists essentially of concrete.

38. A system according to claim 27 wherein said material consists essentially of gravel.

39. A system according to claim 27 wherein said material consists essentially of asphalt.

40. A pavement for facilitating the movement of traffic comprising:

(a) a mat substantially including (1) a substantially planar grid formed substantially by a plurality of intersecting struts, (2) a plurality of substantially upstanding substantially tubular members spaced substantially in an array on said grid with said tubular members being spaced such that a series of pathways are defined by said tubular members, and (3) at least one rib substantially laterally extending across at least one said pathway;

(b) at least one pipe extending through a corresponding one of said pathways and resting upon said at least one rib;

(c) a nozzle in operative communication with said at least one pipe and extending substantially laterally from said at least one pipe;

(d) valve means in operative communication with said at least one pipe for selectively permitting a liquid to flow within said at least one pipe through said nozzle substantially laterally to the exterior of said at least one pipe;

(e) a paving material substantially saturating the region within said tubular members, around said tubular members, and around said at least one pipe, said paving material having an upper, substantially horizontal surface, and said mat, said at least one pipe, and said valve means located substantially below said horizontal surface, said paving material having a substantially open area or void substantially immediately above said nozzle such that said liquid within said at least one pipe may flow through said nozzle, to the exterior of said at least one pipe, and onto said horizontal surface.

41. A pavement according to claim 40 wherein said valve means selectively permits such flow only when the pressure of said liquid within said at least one pipe achieves a predetermined pressure level.

42. A pavement according to claim 40 wherein said at least one rib includes an upper surface possessing a configuration substantially conforming to the peripheral configuration of said at least one pipe in the region where said at least one pipe rests upon said at least one rib.

43. A pavement according to claim 42 wherein said at least one pipe possesses a substantially cylindrically periphery in the region where said at least one pipe rests upon said at least one rib and wherein said at least one rib includes an upper surface possessing a substantially arcuate configuration substantially conforming to the peripheral configuration of said at least one pipe in said region.

44. A pavement according to claim 43 wherein said arcuate configuration forms substantially an arc in the range of about 45 to 120 degrees.

45. A pavement according to claim 43 wherein said arcuate configuration forms substantially an arc in the range of about 160 to 270 degrees.

46. A pavement according to claim 40 wherein said at least one rib includes a cavity through which said at least one pipe extends.

47. A pavement according to claim 46 wherein said at least one rib includes an upper opening and further includes at least one resilient ear flexible in at least one direction to facilitate the placement of said at least one pipe into and the removal of said at least one pipe from a position of extension within said at least one rib cavity.

48. A pavement according to claim 47 wherein said paving material consists essentially of asphalt.

49. A pavement according to claim 40 wherein said paving material consists essentially of sod and grass.

50. A pavement according to claim 40 wherein said paving material consists essentially of concrete.

51. A pavement according to claim 40 wherein said paving material consists essentially of gravel.

52. A pavement according to claim 40 wherein said paving material consists essentially of asphalt.

53. A system for applying a liquid upon a surface of a material, comprising (a) a mat substantially including (1) a substantially planar grid formed substantially by a plurality of intersecting struts, (2) a plurality of substantially upstanding substantially tubular members spaced substantially in an array on said grid with said tubular members being spaced such that a series of pathways are defined by said tubular members, and (3) at least one rib substantially laterally extending across at least one said pathway;

(b) at least one pipe extending through a corresponding one of said pathways and extending through said at least one rib; and (c) valve means in operative communication with said at least one pipe for selectively permitting said liquid to flow within said at least one pipe substantially laterally to the exterior of said at least one pipe.

54. A system according to claim 53 wherein said valve means selectively permits such flow only when the pressure of said liquid within said at least one pipe achieves a predetermined pressure level.

55. A system according to claim 53 wherein said at least one rib includes a cavity through which said at least one pipe extends.

56. A system according to claim 53 wherein said paving material consists essentially of sod and grass.

57. A system according to claim 53 wherein said paving material consists essentially of asphalt.

58. A pavement for facilitating the movement of traffic comprising:

(a) a mat substantially including (1) a substantially planar grid formed substantially by a plurality of intersecting struts, (2) a plurality of substantially upstanding substantially tubular members spaced substantially in an array on said grid with said tubular members being spaced such that a series of pathways are defined by said tubular members, and (3) at least one rib substantially laterally extending across at least one said pathway;

(b) at least one pipe extending through a corresponding one of said pathways and extending through said at least one rib;

(c) a nozzle in operative communication with said at least one pipe and extending substantially laterally from said at least one pipe;

(d) valve means in operative communication with said at least one pipe for selectively permitting a liquid to flow within said at least one pipe through said nozzle substantially laterally to the exterior of said at least one pipe;

(e) a paving material substantially saturating the region within said tubular members, around said tubular members, and around said at least one pipe, said paving material having an upper, substantially horizontal surface, and said mat, said at least one pipe, and said valve means located substantially below said horizontal surface, said paving material having a substantially open area or void substantially immediately above said nozzle such that said liquid within said at least one pipe may flow through said nozzle, to the exterior of said at least one pipe, and onto said horizontal surface.

59. A pavement according to claim 58 wherein said valve means selectively permits such flow only when the pressure of said liquid within said at least one pipe achieves a predetermined pressure level.

60. A pavement according to claim 58 wherein said at least one rib includes a cavity through which said at least one pipe extends.

61. A pavement according to claim 58 wherein said paving material consists essentially of sod and grass.

62. A pavement according to claim 58 wherein said paving material consists essentially of asphalt.

* * * * *